US012799421B2

(12) United States Patent
Ransom et al.

(10) Patent No.: US 12,799,421 B2
(45) Date of Patent: Nov. 17, 2026

(54) DETERGENT SYSTEMS FOR IMPROVED PISTON CLEANLINESS

(71) Applicant: Afton Chemical Corporation, Richmond, VA (US)

(72) Inventors: Paul Ransom, Marsden (GB); Jason Bell, Powhatan, VA (US); Samuel Bruce Field, Richmond, VA (US); Guillaume Carpentier, Bracknell (GB)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 18/765,584

(22) Filed: Jul. 8, 2024

(65) Prior Publication Data

US 2024/0360376 A1 Oct. 31, 2024

Related U.S. Application Data

(63) Continuation-in-part of application No. 17/879,378, filed on Aug. 2, 2022, now abandoned.

(51) Int. Cl.

| | |
|---|---|
| ***C10M 135/10*** | (2006.01) |
| ***C10M 159/24*** | (2006.01) |
| ***C10N 10/02*** | (2006.01) |
| ***C10N 10/04*** | (2006.01) |
| ***C10N 30/00*** | (2006.01) |
| ***C10N 30/04*** | (2006.01) |
| ***C10N 30/10*** | (2006.01) |

(52) U.S. Cl.

CPC ..... *C10M 135/10* (2013.01); *C10M 159/24* (2013.01); *C10M 2219/044* (2013.01); *C10M 2219/046* (2013.01); *C10N 2010/02* (2013.01); *C10N 2010/04* (2013.01); *C10N 2030/04* (2013.01); *C10N 2030/10* (2013.01); *C10N 2030/52* (2020.05)

(58) Field of Classification Search

CPC ..... C10M 135/10; C10M 159/24; C10M 2219/044; C10M 2219/046; C10N 2010/02; C10N 2010/04; C10N 2030/04; C10N 2030/10; C10N 2030/52

See application file for complete search history.

(56) References Cited

U.S. PATENT DOCUMENTS

| | | | |
|---|---|---|---|
| 1,857,214 | A | 5/1932 | Rowe |
| 2,995,569 | A | 8/1961 | Hamilton et al. |
| 3,178,663 | A | 4/1965 | Kahn |
| 3,185,647 | A | 5/1965 | Anderson et al. |
| 3,189,544 | A | 6/1965 | Ratner et al. |
| 3,256,185 | A | 6/1966 | LeSuer |
| 3,278,550 | A | 10/1966 | Norman et al. |
| 3,312,619 | A | 4/1967 | Vineyard |
| 3,366,569 | A | 1/1968 | Norman et al. |
| 3,390,086 | A | 6/1968 | O'Halloran |
| 3,403,102 | A | 9/1968 | LeSuer |
| 3,458,530 | A | 7/1969 | Pawson et al. |
| 3,470,098 | A | 9/1969 | O'Halloran |
| 3,471,404 | A | 10/1969 | Myers |
| 3,502,677 | A | 3/1970 | LeSner |
| 3,519,564 | A | 7/1970 | Vogel |
| 3,546,243 | A | 12/1970 | Coupland |
| 3,573,205 | A | 3/1971 | Lowe et al. |
| 3,634,515 | A | 1/1972 | Piasek et al. |
| 3,649,229 | A | 3/1972 | Otto |
| 3,673,090 | A | 6/1972 | Waldbillig et al. |
| 3,703,504 | A | 11/1972 | Horodysky et al. |
| 3,703,505 | A | 11/1972 | Horodysky et al. |
| 3,708,522 | A | 1/1973 | LeSuer |
| 3,749,695 | A | 7/1973 | deVries |
| 3,796,661 | A | 3/1974 | Suratwala et al. |
| 3,859,318 | A | 1/1975 | Lesuer |
| 3,865,740 | A | 2/1975 | Goldschmidt |
| 3,865,813 | A | 2/1975 | Gergel |
| 3,873,454 | A | 3/1975 | Horodysky et al. |
| 3,954,639 | A | 5/1976 | Liston |
| 4,119,549 | A | 10/1978 | Davis |
| 4,119,550 | A | 10/1978 | Davis et al. |
| 4,147,640 | A | 4/1979 | Jayne et al. |
| 4,152,499 | A | 5/1979 | Boerzel et al. |
| 4,191,659 | A | 3/1980 | Davis |
| 4,204,969 | A | 5/1980 | Papay et al. |
| 4,234,435 | A | 11/1980 | Meinhardt et al. |
| 4,240,958 | A | 12/1980 | Braid |
| 4,259,194 | A | 3/1981 | deVries et al. |
| 4,259,195 | A | 3/1981 | King et al. |

(Continued)

FOREIGN PATENT DOCUMENTS

| | | | |
|---|---|---|---|
| CN | 102575186 | A | 7/2012 |
| CN | 109790482 | A | 5/2019 |

(Continued)

OTHER PUBLICATIONS

Lubrizol, "Understanding the CEC L-117 Piston Cleanliness Test", retrieved from the internet at < https://360.lubrizol.com/2021/Understanding-the-CEC-L-117-Piston-Cleanliness-Test> on Jan. 3, 2024 (Year: 2024).*

(Continued)

*Primary Examiner* — James C Goloboy

(74) *Attorney, Agent, or Firm* — HONIGMAN LLP

(57) ABSTRACT

The present disclosure relates to lubricating compositions achieving piston cleanliness pursuant to CEC L-117-20 (VW TDi3) that fail to achieve desired piston cleanliness pursuant to CEC L-078-99 (VW TDi2).

13 Claims, No Drawings

(56) References Cited

U.S. PATENT DOCUMENTS

| | | | |
|---|---|---|---|
| 4,261,843 | A | 4/1981 | King et al. |
| 4,263,152 | A | 4/1981 | King et al. |
| 4,265,773 | A | 5/1981 | deVries et al. |
| 4,272,387 | A | 6/1981 | King et al. |
| 4,283,295 | A | 8/1981 | deVries et al. |
| 4,285,822 | A | 8/1981 | deVries et al. |
| 4,344,854 | A | 8/1982 | Davis et al. |
| 4,379,064 | A | 4/1983 | Cengel et al. |
| 4,472,306 | A | 9/1984 | Powers, III et al. |
| 4,482,464 | A | 11/1984 | Karol et al. |
| 4,521,318 | A | 6/1985 | Karol |
| 4,554,086 | A | 11/1985 | Karol et al. |
| 4,579,675 | A | 4/1986 | Sawicki et al. |
| 4,612,132 | A | 9/1986 | Wollenberg et al. |
| 4,614,522 | A | 9/1986 | Buckley |
| 4,614,603 | A | 9/1986 | Wollenberg |
| 4,617,137 | A | 10/1986 | Plavac |
| 4,617,138 | A | 10/1986 | Wollenberg |
| 4,636,322 | A | 1/1987 | Nalesnik |
| 4,645,515 | A | 2/1987 | Wollenberg |
| 4,646,860 | A | 3/1987 | Owens et al. |
| 4,647,390 | A | 3/1987 | Buckley, III et al. |
| 4,648,886 | A | 3/1987 | Buckley, III et al. |
| 4,648,980 | A | 3/1987 | Erdman |
| 4,652,387 | A | 3/1987 | Andress, Jr. et al. |
| 4,663,062 | A | 5/1987 | Wollenberg |
| 4,663,064 | A | 5/1987 | Nalesnik et al. |
| 4,666,459 | A | 5/1987 | Wollenberg |
| 4,666,460 | A | 5/1987 | Wollenberg |
| 4,668,246 | A | 5/1987 | Wollenberg |
| 4,670,170 | A | 6/1987 | Wollenberg |
| 4,699,724 | A | 10/1987 | Nalesnik et al. |
| 4,711,736 | A | 12/1987 | Horodysky et al. |
| 4,713,189 | A | 12/1987 | Nalesnik et al. |
| 4,713,191 | A | 12/1987 | Nalesnik |
| 4,948,386 | A | 8/1990 | Sung et al. |
| 4,954,274 | A | 9/1990 | Zaweski et al. |
| 4,963,275 | A | 10/1990 | Gutierrez et al. |
| 4,963,278 | A | 10/1990 | Blain et al. |
| 4,966,720 | A | 10/1990 | DeGonia et al. |
| 4,971,598 | A | 11/1990 | Andress et al. |
| 4,971,711 | A | 11/1990 | Lundberg et al. |
| 4,973,412 | A | 11/1990 | Migdal et al. |
| 4,981,492 | A | 1/1991 | Blain et al. |
| 5,026,495 | A | 6/1991 | Emert et al. |
| 5,030,249 | A | 7/1991 | Herbstman et al. |
| 5,039,307 | A | 8/1991 | Herbstman et al. |
| 5,075,383 | A | 12/1991 | Migdal et al. |
| 5,241,003 | A | 8/1993 | Degonia et al. |
| 5,334,321 | A | 8/1994 | Harrison et al. |
| 5,362,419 | A | 11/1994 | Zinke et al. |
| 5,578,236 | A | 11/1996 | Srinivasan et al. |
| 5,650,381 | A | 7/1997 | Gatto et al. |
| 5,739,355 | A | 4/1998 | Gateau et al. |
| 5,883,057 | A | 3/1999 | Roell, Jr. et al. |
| 5,922,657 | A | 7/1999 | Camenzind et al. |
| 6,107,257 | A | 8/2000 | Valcho et al. |
| 6,451,745 | B1 | 9/2002 | Ward |
| 6,723,685 | B2 | 4/2004 | Hartley et al. |
| 7,214,649 | B2 | 5/2007 | Loper et al. |
| 7,253,231 | B2 | 8/2007 | Devlin et al. |
| 7,485,603 | B2 | 2/2009 | Bera et al. |
| 7,645,726 | B2 | 1/2010 | Loper |
| 7,732,390 | B2 | 6/2010 | Kadkhodayan et al. |
| 7,786,057 | B2 | 8/2010 | Bera et al. |
| 7,897,696 | B2 | 3/2011 | Huang et al. |
| 8,048,831 | B2 | 11/2011 | Loper |
| 2006/0063685 | A1 | 3/2006 | Purmer et al. |
| 2006/0116302 | A1 | 6/2006 | Deckman et al. |
| 2006/0264340 | A1 | 11/2006 | Iyer et al. |
| 2009/0233822 | A1 | 9/2009 | Iyer |
| 2009/0233823 | A1 | 9/2009 | Fahl et al. |
| 2011/0015105 | A1 | 1/2011 | Davies et al. |
| 2011/0212863 | A1 | 9/2011 | Yagishita |
| 2012/0101017 | A1 | 4/2012 | Duggal |
| 2012/0178655 | A1* | 7/2012 | Jones ..... C10M 163/00 508/463 |
| 2013/0008756 | A1 | 1/2013 | Noles, Jr. et al. |
| 2014/0038866 | A1 | 2/2014 | Barton |
| 2014/0097059 | A1 | 4/2014 | Tang et al. |
| 2015/0210953 | A1 | 7/2015 | Davies et al. |
| 2017/0267941 | A1 | 9/2017 | Zhang |
| 2018/0044610 | A1 | 2/2018 | Mayhew et al. |
| 2018/0346839 | A1 | 12/2018 | Fletcher et al. |
| 2019/0127655 | A1* | 5/2019 | Dance ..... C10M 129/54 |
| 2020/0140775 | A1 | 5/2020 | Smith et al. |
| 2020/0208074 | A1* | 7/2020 | Jones ..... C10M 141/12 |
| 2024/0059999 | A1 | 2/2024 | Ransom et al. |

FOREIGN PATENT DOCUMENTS

| | | | |
|---|---|---|---|
| CN | 113166670 | A | 7/2021 |
| EP | 612839 | A1 | 8/1994 |
| EP | 0894845 | A1 | 2/1999 |
| EP | 1233054 | A2 | 8/2002 |
| EP | 1262538 | A1 | 12/2002 |
| EP | 0856042 | B1 | 1/2003 |
| EP | 1529831 | A2 | 5/2005 |
| EP | 2446004 | A1 | 5/2012 |
| EP | 2245124 | B1 | 5/2016 |
| GB | 1065595 | A | 4/1967 |
| GB | 2140811 | A | 12/1984 |
| JP | 2009286848 | A | 12/2009 |
| JP | 2017533985 | A | 11/2017 |
| JP | 2020527633 | A | 9/2020 |
| JP | 2024021062 | A | 2/2024 |
| WO | 03064570 | A1 | 8/2003 |
| WO | 2020203524 | A1 | 10/2020 |

OTHER PUBLICATIONS

Extended European Search Report, Application No. EP 24207131.4, dated Mar. 17, 2025.

Huanmou et al., "Lubricity of Carboxyl Acid Derivatives of O,O-dialkyl-phosphorodithioate," Journal of Hunan University, vol. 23, No. 3, (1996), pp. 65-70.

Lubrizol, "Understandng the CEC L-117 Piston Cleanliness Test", retrieved from the internet at <http://360.lubrizol.com/2021/Understandng-the-CEC-L-117-Piston-Cleanliness-Test> on Jan. 3, 2024 (Year: 2021).

* cited by examiner

DETERGENT SYSTEMS FOR IMPROVED PISTON CLEANLINESS

CROSS-REFERENCE TO RELATED APPLICATION

The present application is a Continuation-in-Part of U.S. application Ser. No. 17/879,378 filed on Aug. 2, 2022, which is incorporated herein by reference in its entirety.

TECHNICAL FIELD

The present disclosure relates to lubricating compositions and, in particular, lubricating compositions exhibiting improved piston cleanliness with select detergent systems and lower levels of antioxidants.

BACKGROUND

Automotive manufacturers continue to the push for improved efficiency, fluid longevity, and fuel economy, and as such, demands on engines, lubricants, and their components continue to increase. Today's engines are often smaller, lighter and more efficient with technologies designed to improve fuel economy, performance, and power. These requirements also mean engine oil performance must evolve to meet the higher demands of such modern engines and their corresponding performance criteria tied to their unique use and applications. With such exacting demands for engine oils, lubricant manufacturers often tailor lubricants and their additives to meet certain performance requirements for industry and/or manufacturer applications. Typically, industry standards and/or automotive manufacturers require certain performance standards such that a lubricant designed for one use or application may not satisfy all the performance specifications for a different use or application.

For example, detergent choice in an engine oil formulation was often based on a number of factors, including but not limited to, piston cleanliness, acid neutralization, TBN retention, oxidation, low speed pre-ignition, wear, friction performance, fuel economy, supply, and/or cost factors to suggest but a few relevant considerations. However, it has previously been accepted that piston cleanliness in diesel engines typically required the use of detergent sources other than sulfonate; thus, diesel piston cleanliness generally required, for instance, combinations of phenate and sulfonate detergents. If other detergents were included (such as sulfonates, phenates, and/or salicylates, and the like), then prior detergent systems were often coupled with higher levels of antioxidants or base oil systems including higher levels of API Group IV base oils. As such, this required combination to achieve piston cleanliness tended to create formulation shortcomings by limiting the selection of supplementary componentry in the formulation and/or tended to cause formulation tradeoffs that could impact overall performance.

More specifically, the most severe industry test to demonstrate diesel piston cleanliness was CEC L-078-99 commonly known as the VW TDi2 test. Lubricants evaluated pursuant to VW TDi2 exhibited a clear response to formulations including phenate-based detergents, higher levels of antioxidants, and/or higher levels of API Group IV (e.g. PAO) base oils such that preferred lubricants to pass this performance standard included phenate detergents or combinations of other detergents with phenate additives with the higher levels of antioxidants and/or higher levels of synthetic base oils. Recently, the VW TDi2 performance test was replaced with CEC L-117-20 or the so-called VW TDi3 test. This updated evaluation is based on a newer engine and runs even more severe conditions than the prior evaluation. As such, engine lubricants must now demonstrate passing performance when subjected to the more severe operating conditions of the new TDi3 test. In many circumstances, however, varying components within a lubricant composition to satisfy newer performance characteristics tends to negatively impact one or more other performance characteristics Thus, it becomes challenging for the lubricant manufacturer to meet newer industry performance demands while also maintaining traditional fluid performance at the same time.

SUMMARY

The present disclosure relates to lubricating compositions achieving passing piston cleanliness in the CEC L-117-20 (VW TDi3) test. In one approach or embodiment, the lubricating composition includes one or more base oils of lubricating viscosity (preferably, less than 20 weight percent of API Group IV base oils); less than 2 weight percent of total antioxidant compounds selected from aminic antioxidant compounds, phenolic antioxidant compounds, molybdenum antioxidant compounds, or combinations thereof; less than 100 ppm of boron; a detergent system having a total base number (TBN) of at least 5.5 mg KOH/g as measured by ASTM D2896 and having a soap content of about 75 percent or more of sulfonate soap and about 25 percent or less of phenate soap, salicylate soap, calixarate soap, or combinations thereof. In some embodiments, the lubricating composition exhibits an average piston cleanliness equivalent to or better than RL 276-5 reference fluid merits, which in some embodiments is 53 merits or higher in the CEC L-117-20 (VW TDi3) piston cleanliness test of RL276-5.

In other approaches or embodiments, the lubricating composition of the previous paragraph may include other features, embodiments, or elements in any combination. These other features, embodiments, or elements include one or more of the following: wherein the detergent system has less than about 5 percent phenate soap, salicylate soap, calixarate soap, or combinations thereof; and/or wherein the detergent system has a TBN (ASTM D2896) of 5.5 to 15 mg KOH/g and provides 0.3 to 0.7 weight percent sulfonate soap; and/or wherein the lubricating composition has a ratio of the detergent system TBN (ASTM D2896) relative to the sulfonate soap content of 13 to 18; and/or wherein the detergent system consists essentially of one or more of magnesium sulfonate, sodium sulfonate, or calcium sulfonate in amounts to provide the detergent system TBN; and/or wherein the detergent system includes only magnesium sulfonate, sodium sulfonate, calcium sulfonate, or combinations thereof in amounts to provide the detergent system TBN; and/or wherein the detergent system provides about 0.3 weight percent to about 0.7 weight percent of sulfonate soap; and/or wherein the detergent system has about 1 percent or less of phenate soap, salicylate soap, calixarate soap, or combinations thereof (preferably, no detectable amounts of phenate soap, salicylate soap, calixarate soap, or combinations thereof); and/or wherein the detergent system provides at least one of calcium, magnesium, sodium, or combination thereof in amounts, individually or in combination, up to about 5000 ppm; and/or wherein the lubricating composition has less than about 1.3 weight percent of total antioxidant compounds; and/or wherein the lubricating composition has less than about 5 weight percent of API Group IV base oils; and/or wherein the detergent system has a ratio of sulfonate soap to phenate soap of about 95:5 or greater; and/or wherein the detergent system is a blend of neutral to low-based sulfonate detergents and overbased sulfonate detergents in amounts to provide the detergent system TBN; and/or wherein the detergent system includes about 0 to about 7 weight percent of sulfonate detergents from neutral to low-based sulfonate detergents and about 0.1 to about 3.0 weight percent of sulfonate detergents from overbased sulfonate detergents.

In yet other approaches or embodiments, a method of passing the CEC L-117-20 piston cleanliness test is provided herein. In aspects of this approach or embodiment, the method includes providing a lubricating composition including one or more base oils of lubricating viscosity; less than 2 weight percent of total antioxidant compounds selected from aminic antioxidant compounds, phenolic antioxidant compounds, molybdenum antioxidant compounds, or combinations thereof; less than 100 ppm of boron; a detergent system having a total base number (TBN) of at least 5.5 mg KOH/g as measured by ASTM D2896 and having a soap content of about 75 percent or more of sulfonate soap and about 25 percent or less of phenate soap, salicylate soap, calixarate soap, or combinations thereof; and less than 20 weight percent of API Group IV base oils; and then measuring piston cleanliness pursuant to CEC L-117-20 (VW TDi3). In some embodiments, the methods exhibits an average piston cleanliness equivalent to or better than RL 276-5 reference fluid merits, which in some embodiments is 53 merits or higher in the CEC L-117-20 (VW TDi3) piston cleanliness test of RL276-5.

In other approaches or embodiments, the method of the previous paragraph may include other features, steps, or embodiments in any combination. These other features, steps, or embodiments include one or more of the following: wherein the detergent system has about 5 percent or less of phenate soap, salicylate soap, calixarate soap, or combinations thereof; and/or wherein the detergent system has a TBN (ASTM D2896) of 5.5 to 15 mg KOH/g and provides 0.3 to 0.7 weight percent sulfonate soap; and/or wherein the lubricating composition has a ratio of the detergent system TBN (ASTM D2896) relative to the sulfonate soap content of 13 to 18; and/or wherein the detergent system consists essentially of one or more of magnesium sulfonate, sodium sulfonate, or calcium sulfonate in amounts to provide the detergent system TBN; and/or wherein the detergent system includes only magnesium sulfonate, sodium sulfonate, calcium sulfonate, or combinations thereof in amounts to provide the detergent system TBN; and/or wherein the detergent system is substantially free of detergents providing phenate soap, salicylate soap, calixarate soap, or combinations thereof or wherein the detergent system has about 5 percent or less of phenate soap, salicylate soap, calixarate soap, or combinations thereof; and/or wherein the detergent system has about 1 percent or less of phenate soap, salicylate soap, calixarate soap, or combinations thereof; and/or wherein the detergent system provides at least one of calcium, magnesium, sodium, or combination thereof in amounts, individually or in combination, up to about 5000 ppm; and/or wherein the lubricating composition has less than about 1.3 weight percent of total antioxidant compounds; and/or wherein the detergent system has a ratio of sulfonate soap to phenate soap of about 95:5 or greater; and/or wherein the detergent system is a blend of neutral to low-based sulfonate detergents and overbased sulfonate detergents in amounts to provide the detergent system TBN; and/or wherein the detergent system includes about 0 to about 7 weight percent of sulfonate detergent from neutral to low-based sulfonate detergents and about 0.1 to about 3 weight percent of sulfonate detergent from overbased sulfonate detergents; and/or wherein the lubricating composition has less than about 5 weight percent of API Group IV base oils.

In yet another approach or embodiment, the use of a lubricating composition to achieve an average piston cleanliness equivalent to or better than RL 276-5 reference fluid merits in CEC L-117-20 (VW TDi3), which in some embodiments is 53 merits or higher in the CEC L-117-20 (VW TDi3) piston cleanliness test of RL276-5 is also provided herein. In approaches of this embodiment, the lubricating composition is any embodiment as described in this Summary, and in particular, a lubricating composition including one or more base oils of lubricating viscosity; less than 2 weight percent of total antioxidant compounds selected from aminic antioxidant compounds, phenolic antioxidant compounds, molybdenum antioxidant compounds, or combinations thereof; less than 100 ppm of boron; a detergent system having a total base number (TBN) of at least 5.5 mg KOH/g as measured by ASTM D2896 and having a soap content of about 75 percent or more of sulfonate soap and about 25 percent or less of phenate soap, salicylate soap, calixarate soap, or combinations thereof; and less than 20 weight percent of API Group IV base oils.

DETAILED DESCRIPTION

The present disclosure relates to lubricating compositions and methods of lubricating a diesel internal combustion engine effective to achieve passing piston cleanliness pursuant to CEC L-117-20 or the so-called VW TDi3 test. In approaches or embodiments, the lubricating compositions and methods herein include one or more base oils of lubricating viscosity (preferably, the lubricants include less than about 20 weight percent of API Group IV base oils); less than 2 weight percent of total antioxidant compounds (such as aminic antioxidant compounds, phenolic antioxidant compounds, molybdenum antioxidant compounds, or combinations thereof and, more preferably, less than about 1.5 weight percent of total antioxidant compounds); less than 100 ppm of boron (preferably, less than 50 ppm or, more preferably, less than 15 ppm boron); and a detergent system having a total base number (TBN) of at least 5.5 mg KOH/g as measured by ASTM D2896 (preferably, a TBN of 5.5 to 15) and providing a soap content of about 75 percent or more of sulfonate soap and less than about 25 percent of phenate or other types of soap content other than sulfonate (preferably, substantially no phenate soap or no soap content other than sulfonate). Surprisingly, even with compositions including little to no phenate soap or other types of soap content other sulfonates (previously needed to achieve diesel piston cleanliness in prior industry tests), lower levels of total antioxidants, lower levels of total boron compounds, and little to no API Group IV base oils, the lubricating compositions herein meet or exceed lubricant performance set forth in the CEC L-117-20 (VW TDi3) piston cleanliness test.

In yet other approaches or embodiments, the detergent systems herein have a TBN (ASTM D2896) of 5.5 to 15 mg KOH/g and provide 0.3 to 0.7 weight percent sulfonate soap (wherein the total soap is at least about 75 percent sulfonate soap, at least about 80 percent sulfonate soap, at least about 90 percent sulfonate soap, at least about 95 percent sulfonate soap, at least about 98 percent sulfonate soap, or about 100 percent sulfonate soap). In some embodiments, it was also discovered that relative amounts of the sulfonate soap content to the detergent TBN contribution needed to be matched in selected ratios in order to achieve passing TDi3 performance in the context of lubricants having lower antioxidant content, lower boron content, and/or lower levels of API Group IV base oils. For instance, it was discovered that, in some embodiments, when the lubricating compositions herein have a ratio of the detergent system TBN (ASTM D2896) relative to the sulfonate soap content of about 13 to about 18 (as shown in the Examples), and more preferably about 14 to about 16, then the lubricating compositions achieved a passing TDi3 piston cleanliness with less antioxidant, less boron, and less Group IV base oil content.

In yet other embodiments, the lubricating oil compositions and methods herein consist essentially of, or alternatively, consist of (e.g., consist only of) one or more of magnesium sulfonate, sodium sulfonate, or calcium sulfonate in amounts to provide the detergent system TBN and soap content. In other words, the detergent systems herein are predominately sulfonate detergents, and most preferably, sulfonate only detergents with little to no phenate or other detergent types (and most preferably, no phenate or other detergent additives) that was previously needed to pass diesel piston cleanliness tests. Even without phenate soap, lower levels of total antioxidants (e.g., less than about 2 weight percent, less than about 1.5 weight percent, or less than about 1.3 weight percent of total antioxidants), lower levels of boron (e.g., less than 100 ppm, less than 50 ppm, less than 20 ppm, or less than 10 ppm of boron), and little to no Group IV base oils (e.g., less than about 20 weight percent, less than about 10 weight percent, less than about 5 weight percent, less than about 2 weight percent, less than about 1 weight percent or none), the lubricants herein surprisingly pass the more severe TDi3 piston cleanliness test. The detergent systems herein are substantially free of phenate soaps, salicylate soaps, calixarate soaps, or combinations thereof, which means about 25 percent or less, about 20 percent or less, about 15 percent or less, about 10 percent or less, about 5 percent or less, about 2.5 percent or less, about 1 percent or less, or no phenate soap, salicylate soap, calixarate soap, or combinations thereof.

The Detergent System

The lubricating compositions herein include detergent systems that achieve VW TDi3 piston cleanliness with little to no phenate soap, salicylate soap, calixarate soap, or combinations thereof and, preferably no phenate soap, no salicylate soap, no calixarate soap, or combinations thereof. In some approaches, the piston cleanliness is achieved with the detergent systems when minimum TBN levels are maintained by the sulfonate additives, which may be a blend of neutral, low-based, or overbased sulfonate detergents. Preferred TBN levels contributed by the sulfonate detergents are at least 5.5 mg KOH/g, at least 6 mg KOH/g, at least 7 mg KOH/g or at least 8 mg/KOH/g to about 15 mg KOH/g or less, about 12 mg KOH/g or less, about 10 mg KOH/g or less. In embodiments, the detergent systems herein generally include one or more alkali or alkaline metal salts of sulfonates with minor amounts of, residual levels of, or no other detergent additives such as phenates, calixarates, salixarates, salicylates, carboxylic acids, sulfurized derivatives thereof, or combinations thereof so long as the minimum amounts of sulfonate soap, TBN levels, relationships of soap contents, and/or low levels of other detergents described herein are satisfied.

Suitable detergents and their methods of preparation are described in greater detail in numerous patent publications, including U.S. Pat. No. 7,732,390 and references cited therein, which are incorporated herein by reference. The lubricant compositions herein may include about 0.1 to about 5 weight percent of individual and/or total detergent additives, and in other approaches, about 0.15 to about 3 weight percent, and in yet other approaches, about 0.15 to 2.6 weight percent of individual and/or total detergent additives so long as the detergent additives meet the sulfonate amounts and other relationships noted herein.

As noted above and in some approaches, the detergent system provides select amounts of sulfonate soap and TBN levels with certain amounts of detergent metals. For instance, the detergent systems herein may provide an amount of total detergent metals that is greater than about 750 ppm total metal based on the total lubricating composition, and in other approaches, about 1000 ppm to about 5000 ppm total metals, about 1200 ppm to about 3500 ppm total metal, about 1400 to about 3000 ppm total metal, or about 1500 ppm to about 2500 ppm total metals. In other approaches, the detergent metals are calcium, sodium and/or magnesium and preferably, calcium, sodium, and magnesium provided by sulfonates and, more preferably, only calcium, sodium, and/or magnesium sulfonates. Preferably, the metals are calcium, magnesium, or combinations thereof.

Generally, suitable detergents in the system may include linear or branched alkali or alkaline earth metal salts, such as calcium, sodium, or magnesium, of petroleum sulfonic acids and long chain mono- or di-alkylaryl sulfonic acids with the aryl group being benzyl, tolyl, and xylyl and/or various phenates or derivatives of phenates. Examples of suitable detergents include, subject the required amounts of sulfonate soap, low-based/neutral and overbased variations of the following detergents: calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

The detergent additives may be neutral, low-based, or overbased and, preferably, overbased or mixtures of neutral to low-based and overbased detergents as needed to meet the minimum detergent TBN numbers as noted above. As understood, overbased detergent additives are well-known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The term "overbased" relates to metal salts, such as metal salts of sulfonates, carboxylates, salicylates and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the MR is one and in an overbased salt, MR, is greater than one. They are commonly referred to as overbased, hyperbased, or superbased salts and may be salts of organic sulfur acids, carboxylic acids, or phenols.

As used herein, the term "TBN" is used to denote the Total Base Number in mg KOH/g as measured by the method of ASTM D2896. The detergent may be neutral or overbased. For example, a neutral detergent may have a total base number (TBN) of less than about 200 mg KOH/gram. In another example, an overbased detergent of the lubricating oil compositions herein may have a total base number (TBN) of about 200 mg KOH/gram or greater, or about 250 mg KOH/gram or greater, or about 350 mg KOH/gram or greater, or about 375 mg KOH/gram or greater, or about 400 mg KOH/gram or greater. The overbased detergent may have a metal to substrate ratio of from 1.1:1 or less, or from 2:1 or less, or from 4:1 or less, or from 5:1 or less, or from 7:1 or less, or from 10:1 or less, or from 12:1 or less, or from 15:1 or less, or from 20:1 or less.

Examples of suitable overbased detergents (so long as the sulfonate soap and other relationships noted herein are satisfied) include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

Optionally, when a low-based or neutral detergent is incorporated into the detergent system, it generally has a TBN of less than 200 mg KOH/g, up to 175 mg KOH/g, up to 150 mg KOH/g, up to 100 mg KOH/g, or up to 50 mg KOH/g. The low-based/neutral detergent may include a calcium or magnesium-containing detergent. Examples of suitable low-based/neutral detergent (so long as the sulfonate soap and other relationships noted herein are satisfied) include, but are not limited to, calcium sulfonates, calcium phenates, calcium salicylates, magnesium sulfonates, magnesium phenates, and/or magnesium salicylates.

In some embodiments, the detergent used in the lubricants herein include at least an overbased calcium sulfonate, an overbased sodium sulfonate, and/or an overbased magnesium sulfonate with each having a total base number of 200 to 400 and, in other approaches, about 200 to about 350. The above described TBN values reflect those of finished detergent components that have been diluted in a base oil. In some approaches, the detergent systems include a blend of neutral to low-based and also overbased sulfonate detergents and may include about 0 to about 7.0 weight percent of neutral to low-based sulfonate detergents and about 0.1 to about 3.0 weight percent of overbased sulfonate detergents (or in other approaches, about 0.2 to about 2.7 weight percent of overbased sulfonate detergents). In yet another approaches, the detergent systems herein may have a ratio of low-based sulfonate detergents to overbased sulfonate detergents of about 0:3 to about 35:1.

In other embodiments, the TBN of the detergents herein may reflect a neat or non-diluted version of the detergent component. For example, the fluids herein may include overbased calcium or sodium sulfonate as a neat additive having a TBN of about 300 to about 450, and in other approaches, about 380 to about 420, and/or overbased magnesium sulfonate as a neat additive having a TBN of about 500 to about 700, and in other approaches, about 600 to about 700.

More specifically, the detergent systems herein include neutral, low-based, and/or overbased detergents (preferably, neutral to overbased calcium sulfonate, neutral to overbased sodium sulfonate, and/or neutral to overbased magnesium sulfonate) to achieve a detergent TBN as measured by ASTM D2896 of at least 5.5 mg KOH/g, at least about 6 mg KOH/g, at least about 8 mg KOH/g to about 15 mg KOH/g or less, about 12 mg KOH/g or less, or about 10 mg KOH/g or less. The detergent system also provide at least one of calcium, sodium, magnesium, or combination thereof and, thus, one or more of the following metal contents: sodium: up to about 40 ppm of sodium, at least about 40 ppm of sodium, at least about 90 ppm of sodium, at least about 180 ppm of sodium, at least about 200 ppm sodium, at least 300 ppm of sodium, or at least about 400 ppm of sodium (preferably about 40 to about 1,000 ppm of sodium, about 180 ppm to about 1,000 ppm, about 200 ppm to about 1,000 ppm of sodium, 300 ppm to about 1,000 ppm of sodium, or 400 ppm to about 1,000 ppm of sodium); magnesium: up to about 90 ppm of magnesium, at least about 90 ppm of magnesium, at least about 180 ppm of magnesium, at least about 200 ppm magnesium, at least 300 ppm of magnesium, or at least about 400 ppm of magnesium (preferably about 90 to about 3,500 ppm of magnesium, about 180 ppm to about 3,000 ppm, about 200 ppm to about 2,000 ppm of magnesium, 300 ppm to about 1,500 ppm of magnesium, or 400 ppm to about 1,000 ppm of magnesium); or in some embodiments, calcium: up to about 90 ppm of calcium, at least about 90 ppm of calcium, at least about 180 ppm of calcium, at least about 200 ppm calcium, at least 300 ppm of calcium, or at least about 400 ppm of calcium (preferably about 90 to about 3,500 ppm of calcium, about 180 ppm to about 3,000 ppm, about 200 ppm to about 2,000 ppm of calcium, 300 ppm to about 1,500 ppm of calcium, or 400 ppm to about 1,000 ppm of calcium). As shown in the Examples below, lubricants meeting such detergent system contributions surprisingly achieve VW TDi3 piston cleanliness even with little to no levels of phenate detergents.

The detergent systems herein have select levels of sulfonate soap content, and in particular the soap content is at least about 75 percent sulfonate soap, and in other approaches, at least about 80 percent sulfonate soap, at least about 85 sulfonate soap, at least about 90 percent sulfonate soap, at least about 95 sulfonate soap, at least about 98 percent sulfonate soap, at least about 99 percent sulfonate soap, or about 100 percent sulfonate soap (or any ranges therebetween). In others approach, the detergent systems herein have a select weight ratio of sulfonate soap to phenate soap, salicylate soap, calixarate soap, or combinations thereof of about 75:25 or greater, about 80:20 or greater, about 85:15 or greater, about 90:10 or greater, or even about 95:5 or greater (wherein greater in context of the ratio means more sulfonate soap relative to the phenate soap, salicylate soap, calixarate soap, or combinations thereof). Preferably, the detergent systems herein only include residual levels, if any, of phenate soap, salicylate soap, calixarate soap, or soaps other than sulfonate.

In yet other embodiments or approaches, the soap amounts contributed by the detergent systems herein are balanced relative to the select detergent TBN levels to achieve the VW TDi3 piston cleanliness with little to no phenate detergents, lower antioxidants, lower boron, and little to no Group IV base oils. For instance, the detergent system of the lubricants herein, in some embodiments, has a TBN (ASTM D2896) of 5.5 to 15 mg KOH/g (preferably about 5.5 to about 10 or other ranges noted above) and provides 0.3 to 0.7 weight percent sulfonate soap. As shown in the Examples below, when the relationships of the detergent TBN and the sulfonate soap are balanced, such as embodiments wherein the detergent system exhibits a ratio of the detergent system TBN (ASTM D2896) relative to the sulfonate soap content of about 13 to about 18 (preferably, 14 to about 16), then the lubricants surprisingly achieve passing piston cleanliness pursuant to the TDi3 test even with lower levels of total antioxidants, lower levels of total boron, and little to no API Group IV base oils.

Soap content generally refers to the amount of neutral organic acid salt and reflects a detergent's cleansing ability, or detergency, and dirt suspending ability. The soap content of a lubricant can be determined by ASTM D3712. Further discussion on determining soap content can be found in FUELS AND LUBRICANTS HANDBOOK, TECHNOLOGY, PROPERTIES, PERFORMANCE, AND TESTING, George Totten, editor, ASTM International, 2003, relevant portions thereof incorporated herein by reference Antioxidants:

The lubricating oil compositions herein may contain one or more antioxidants, but a limited amounts of total antioxidant compounds. As used herein, antioxidant compounds include, for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Preferably, the antioxidant compounds include or are selected form amine antioxidant compounds, phenolic antioxidant compounds, and/or molybdenum antioxidant compounds.

In one approach, a suitable hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

In other embodiments, useful antioxidants may include diarylamines and high molecular weight phenols. In an embodiment, the lubricating oil composition may contain a mixture of a diarylamine and a high molecular weight phenol antioxidant.

In yet other embodiments, other examples of suitable olefins that may be sulfurized to form a sulfurized olefin antioxidant include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

The one or more antioxidants may be present in total amounts of less than about 2 weight percent, preferably less than about 1.8 weight percent, more preferably, less than about 1.5 weight percent, or most preferably, less than about 1.3 weight percent. In other embodiments, the total amounts of antioxidants may range from about 0.1 weight percent to about 2 weight percent, or about 0.2 weight percent to about 1.8 weight percent, or about 0.5 weight percent to about 1.3 weight percent of the lubricating oil composition.

Boron-Containing Compounds:

The lubricating oil compositions herein may contain limited amounts of one or more boron-containing compounds. Preferably, the lubricating oil compositions herein are substantially free of boron, which means the compositions herein have less than about 100 ppm of boron, less than 80 ppm of boron, less than 50 ppm of boron, less than 20 ppm of boron, less than 10 ppm of boron, less than about 5 ppm, or no detectable amounts of boron. Examples of boron-containing compounds that can be used in the limited amounts noted above in the lubricating compositions herein include borate esters, borated fatty amines, borated epoxides, boron compounds to produce borated detergents, and boron compounds to produce borated dispersants, such as borated succinimide dispersants, as disclosed in U.S. Pat. No. 5,883,057. The total boron-containing compounds, if present individually or used to borate detergents and/or dispersants, can be used in an amount sufficient to provide the limited amounts of total boron noted above.

Dispersants

The lubricating compositions herein also include one or more optional dispersants. Dispersants are often known as ashless-type dispersants because, prior to mixing in a lubricating composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with the number average molecular weight of the polyisobutylene substituent being in the range about 350 to about 50,000, or to about 5,000, or to about 3,000, or to about 2,000, or to about 1,500 as measured by GPC. Succinimide dispersants and their preparation are disclosed, for instance in U.S. Pat. No. 7,897,696 or U.S. Pat. No. 4,234,435, which are incorporated herein by reference. The alkenyl substituent may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

In approaches, preferred amines for the dispersants may be selected from polyamines and hydroxylamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like. In some approaches, a so-called heavy polyamine may be used, which is a mixture of polyalkylene-polyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogen atoms per molecule and with 2 or more primary amines per molecule.

In some embodiments, polyisobutylene (PIB), when included, is a preferred reactant to form the dispersants and may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3,000 may be suitable, as determined by GPC. Such HR-PIB is commercially available, or can be synthesized by the polymerization of isobutene in the presence of a non-chlorinated catalyst such as boron trifluoride, as described in U.S. Pat. No. 4,152,499 and/or U.S. Pat. No. 5,739,355. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696. In one embodiment, the present disclosure further comprises at least one dispersant derived from polyisobutylene succinic anhydride ("PIBSA"). The PIBSA may have an average of between about 1.0 and about 2.0 succinic acid moieties per polymer.

In some approaches, the dispersants in the lubricants herein may optionally be post-treated by conventional methods by a reaction with any of a variety of agents. Suitable post treat agents include boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. (See, e.g., U.S. Pat. Nos. 7,645,726; 7,214,649; 8,048,831; and 5,241,003, which are all incorporated herein by reference in their entireties.)

The boron compound used as a post-treating reagent can be selected from boron oxide, boron halides, boron acids and esters of boron acids in an amount to provide from about 0.1 atomic proportion of boron for each mole of the nitrogen composition to about 20 atomic proportions of boron for each atomic proportion of nitrogen used. The dispersant post-treated with boron may contain from about 0.05 weight percent to about 2.0 weight percent, or in other approaches, about 0.05 weight percent to about 0.7 weight percent boron, based on the total weight of the borated dispersant.

In other approaches, carboxylic acid may also be used as a post-treating reagent and can be saturated or unsaturated mono-, di-, or poly-carboxylic acid. Examples of carboxylic acids include, but are not limited to, maleic acid, fumaric acid, succinic acid, and naphthalic diacid (e.g., 1,8-naphthalic diacid). Anhydrides can also be used as a post-treating reagent and can be selected from the group consisting of mono-unsaturated anhydride (e.g., maleic anhydride), alkyl or alkylene-substituted cyclic anhydrides (e.g., succinic anhydride or glutamic anhydride), and aromatic carboxylic anhydrides (including naphthalic anhydride, e.g., 1,8-naphthalic anhydride).

In one embodiment, the process of post-treating the dispersant includes first forming the succinimide product, as described above, and then further reacting the succinimide product with the post treating agent, such as a boron compound, such as boric acid. In some cases, the dispersants herein may be post-treated with more than one post-treatment agents. For example, the dispersant may be post-treated with a boron compound, such as boric acid, and also an anhydride, such as maleic anhydride and/or 1,8-naphthalic anhydride.

The dispersant can be used in an amount sufficient to provide up to about 20 weight percent of the lubricating composition and wherein one or more of the dispersants are post treated to provide at least about 40 ppm of boron and up to 500 ppm of boron to the lubricating composition. In other approaches, the dispersant may be used in the lubricating composition in amounts from about 0.1 weight percent to about 15 weight percent, or about 0.1 weight percent to about 10 weight percent, about 0.1 weight percent to 8 weight percent, or about 1 weight percent to about 10 weight percent, or about 1 weight percent to about 8 weight percent, or about 1 weight percent to about 6 weight percent, based upon the final weight of the lubricating oil composition. Dispersants may provide at least about 400 ppm nitrogen and up to about 1,500 ppm nitrogen.

Base Oil or Base Oil Blend:

The base oil used in the lubricating compositions herein may be oils of lubricating viscosity and selected from any of the base oils in API Groups I to V as specified in the American Petroleum Institute (API) Base Oil Interchangeability Guidelines, but generally include little to no API group IV base oils (e.g., about 20 weight percent or less, about 10 weight percent or less, about 4 weight percent or less, about 2 weight percent or less, or about 1 weight percent or less, or most preferably, no API Group IV base oils). The five base oil groups are generally set forth in Table 1 below:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+ may comprise high viscosity index Group II.

The base oil blend used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV (limited amounts as noted above), a Group V, or a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

The base oil systems herein, in some approaches or embodiments, include one or more of a Group I to Group V base oils and may have a KV100 of about 2 to about 20 cSt, in other approaches, about 2 to about 10 cSt, about 2.5 to about 6 cSt, in yet other approaches, about 2.5 to about 3.5 cSt, and in other approaches about 2.5 to about 4.5 cSt.

As used herein, the terms "oil composition," "lubrication composition," "lubricating oil composition," "lubricating oil," "lubricant composition," "fully formulated lubricant composition," "lubricant," and "lubricating and cooling fluid" are considered synonymous, fully interchangeable terminology referring to the finished lubrication product comprising a major amount of a base oil component plus minor amounts of the detergents and the other optional components.

Optional Additives:

The lubricating oil compositions herein may also include a number of optional additives combined with the detergent systems, sulfurized additives, and boronated detergents as needed to meet performance standards. Those optional additives are described in the following paragraphs.

Other Dispersants: The lubricating oil composition may optionally include one or more other dispersants or mixtures thereof. Dispersants are often known as ashless-type dispersants because, prior to mixing in a lubricating oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with the number average molecular weight of the polyisobutylene substituent being in the range about 350 to about 50,000, or to about 5,000, or to about 3,000, as measured by GPC. Succinimide dispersants and their preparation are disclosed, for instance in U.S. Pat. No. 7,897,696 or U.S. Pat. No. 4,234,435. The alkenyl substituent may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

Preferred amines are selected from polyamines and hydroxylamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like.

A suitable heavy polyamine is a mixture of polyalkylenepolyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogen atoms per molecule and with 2 or more primary amines per molecule. The heavy polyamine comprises more than 28 wt. % (e.g. >32 wt. %) total nitrogen and an equivalent weight of primary amine groups of 120-160 grams per equivalent.

In some approaches, suitable polyamines are commonly known as PAM and contain a mixture of ethylene amines where TEPA and pentaethylene hexamine (PEHA) are the major part of the polyamine, usually less than about 80%.

Typically, PAM has 8.7-8.9 milliequivalents of primary amine per gram (an equivalent weight of 115 to 112 grams per equivalent of primary amine) and a total nitrogen content of about 33-34 wt. %. Heavier cuts of PAM oligomers with practically no TEPA and only very small amounts of PEHA but containing primarily oligomers with more than 6 nitrogen atoms and more extensive branching, may produce dispersants with improved dispersancy.

In an embodiment the present disclosure further comprises at least one polyisobutylene succinimide dispersant derived from polyisobutylene with a number average molecular weight in the range about 350 to about 50,000, or to about 5000, or to about 3000, as determined by GPC. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable, as determined by GPC. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment, the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights determined by gel permeation chromatography (GPC) using commercially available polystyrene standards (with a number average molecular weight of 180 to about 18,000 as the calibration reference).

In one embodiment, the dispersant may be derived from a polyalphaolefin (PAO) succinic anhydride. In one embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

A suitable class of nitrogen-containing dispersants may be derived from olefin copolymers (OCP), more specifically, ethylene-propylene dispersants which may be grafted with maleic anhydride. A more complete list of nitrogen-containing compounds that can be reacted with the functionalized OCP are described in U.S. Pat. Nos. 7,485,603; 7,786,057; 7,253,231; 6,107,257; and 5,075,383; and/or are commercially available.

One class of suitable dispersants may also be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may also be high molecular weight esters or half ester amides. A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with: Inorganic phosphorous acids or anhydrates (e.g., U.S. Pat. Nos. 3,403,102 and 4,648,980); Organic phosphorous compounds (e.g., U.S. Pat. No. 3,502,677); Phosphorous pentasulfides; Boron compounds as already noted above (e.g., U.S. Pat. Nos. 3,178,663 and 4,652,387); Carboxylic acid, polycarboxylic acids, anhydrides and/or acid halides (e.g., U.S. Pat. Nos. 3,708,522 and 4,948,386); Epoxides polyepoxiates or thioexpoxides (e.g., U.S. Pat. Nos. 3,859,318 and 5,026,495); Aldehyde or ketone (e.g., U.S. Pat. No. 3,458,530); Carbon disulfide (e.g., U.S. Pat. No. 3,256,185); Glycidol (e.g., U.S. Pat. No. 4,617,137); Urea, thiourea or guanidine (e.g., U.S. Pat. Nos. 3,312,619; 3,865,813; and British Patent GB 1,065,595);

Organic sulfonic acid (e.g., U.S. Pat. No. 3,189,544 and British Patent GB 2,140,811); Alkenyl cyanide (e.g., U.S. Pat. Nos. 3,278,550 and 3,366,569); Diketene (e.g., U.S. Pat. No. 3,546,243); A diisocyanate (e.g., U.S. Pat. No. 3,573,205); Alkane sultone (e.g., U.S. Pat. No. 3,749,695); 1,3-Dicarbonyl Compound (e.g., U.S. Pat. No. 4,579,675); Sulfate of alkoxylated alcohol or phenol (e.g., U.S. Pat. No. 3,954,639); Cyclic lactone (e.g., U.S. Pat. Nos. 4,617,138; 4,645,515; 4,668,246; 4,963,275; and 4,971,711); Cyclic carbonate or thiocarbonate linear monocarbonate or polycarbonate, or chloroformate (e.g., U.S. Pat. Nos. 4,612,132; 4,647,390; 4,648,886; 4,670,170); Nitrogen-containing carboxylic acid (e.g., U.S. Pat. No. 4,971,598 and British Patent GB 2,140,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603 and 4,666,460); Cyclic carbonate or thiocarbonate, linear monocarbonate or polycarbonate, or chloroformate (e.g., U.S. Pat. Nos. 4,612,132; 4,647,390; 4,646,860; and 4,670,170); Nitrogen-containing carboxylic acid (e.g., U.S. Pat. No. 4,971,598 and British Patent GB 2,440,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603, and 4,666,460); Cyclic carbamate, cyclic thiocarbamate or cyclic dithiocarbamate (e.g., U.S. Pat. Nos. 4,663,062 and 4,666,459); Hydroxyaliphatic carboxylic acid (e.g., U.S. Pat. Nos. 4,482,464; 4,521,318; 4,713,189); Oxidizing agent (e.g., U.S. Pat. No. 4,379,064); Combination of phosphorus pentasulfide and a polyalkylene polyamine (e.g., U.S. Pat. No. 3,185,647); Combination of carboxylic acid or an aldehyde or ketone and sulfur or sulfur chloride (e.g., U.S. Pat. Nos. 3,390,086; 3,470,098); Combination of a hydrazine and carbon disulfide (e.g. U.S. Pat. No. 3,519,564); Combination of an aldehyde and a phenol (e.g., U.S. Pat. Nos. 3,649,229; 5,030,249; 5,039,307); Combination of an aldehyde and an O-diester of dithiophosphoric acid (e.g., U.S. Pat. No. 3,865,740); Combination of a hydroxyaliphatic carboxylic acid and a boric acid (e.g., U.S. Pat. No. 4,554,086); Combination of a hydroxyaliphatic carboxylic acid, then formaldehyde and a phenol (e.g., U.S. Pat. No. 4,636,322); Combination of a hydroxyaliphatic carboxylic acid and then an aliphatic dicarboxylic acid (e.g., U.S. Pat. No. 4,663,064); Combination of formaldehyde and a phenol and then glycolic acid (e.g., U.S. Pat. No. 4,699,724); Combination of a hydroxyaliphatic carboxylic acid or oxalic acid and then a diisocyanate (e.g. U.S. Pat. No. 4,713,191); Combination of inorganic acid or anhydride of phosphorus or a partial or total sulfur analog thereof and a boron compound (e.g., U.S. Pat. No. 4,857,214); Combination of an organic diacid then an unsaturated fatty acid and then a nitrosoaromatic amine optionally followed by a boron compound and then a glycolating agent (e.g., U.S. Pat. No. 4,973,412); Combination of an aldehyde and a triazole (e.g., U.S. Pat. No. 4,963,278); Combination of an aldehyde and a triazole then a boron compound (e.g., U.S. Pat. No. 4,981,492); Combination of cyclic lactone and a boron compound (e.g., U.S. Pat. Nos. 4,963,275 and 4,971,711). The above-mentioned patents are herein incorporated in their entireties.

The TBN of a suitable dispersant may be from about 10 to about 65 mg KOH/g dispersant, on an oil-free basis, which is comparable to about 5 to about 30 TBN if measured on a dispersant sample containing about 50% diluent oil. TBN is measured by the method of ASTM D2896.

In yet other embodiments, the optional dispersant additive may be a hydrocarbyl substituted succinamide or succinimide dispersant. In approaches, the hydrocarbyl substituted succinamide or succinimide dispersant may be derived from a hydrocarbyl substituted acylating agent reacted with a polyalkylene polyamine and wherein the hydrocarbyl substituent of the succinamide or the succinimide dispersant is a linear or branched hydrocarbyl group having a number average molecular weight of about 250 to about 5,000 as measured by GPC using polystyrene as a calibration reference.

In some approaches, the polyalkylene polyamine used to form the dispersant has the Formula

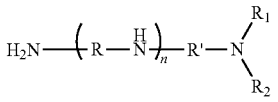

wherein each R and R', independently, is a divalent C1 to C6 alkylene linker, each $R_1$ and $R_2$, independently, is hydrogen, a C1 to C6 alkyl group, or together with the nitrogen atom to which they are attached form a 5- or 6-membered ring optionally fused with one or more aromatic or non-aromatic rings, and n is an integer from 0 to 8. In other approaches, the polyalkylene polyamine is selected from the group consisting of a mixture of polyethylene polyamines having an average of 5 to 7 nitrogen atoms, triethylenetetramine, tetraethylenepentamine, and combinations thereof.

The dispersant, if present, can be used in an amount sufficient to provide up to about 20 wt %, based upon the final weight of the lubricating oil composition. Another amount of the dispersant that can be used may be about 0.1 wt % to about 15 wt %, or about 0.1 wt % to about 10 wt %, about 0.1 to 8 wt %, or about 1 wt % to about 10 wt %, or about 1 wt % to about 8 wt %, or about 1 wt % to about 6 wt %, based upon the final weight of the lubricating oil composition. In some embodiments, the lubricating oil composition utilizes a mixed dispersant system. A single type or a mixture of two or more types of dispersants in any desired ratio may be used.

Antiwear Agents: The lubricating oil compositions herein also may optionally contain one or more antiwear agents. Examples of suitable antiwear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkyldithiophosphate.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Additional Detergents: The lubricating oil composition may optionally further comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein.

The detergent substrate may be salted with an alkali or alkaline earth metal such as, but not limited to, calcium, magnesium, potassium, sodium, lithium, barium, or mixtures thereof. In some embodiments, the detergent is free of barium. In some embodiments, a detergent may contain traces of other metals such as magnesium or calcium in amounts such as 50 ppm or less, 40 ppm or less, 30 ppm or less, 20 ppm or less, or 10 ppm or less. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent of the lubricating oil composition may have a total base number (TBN) of about 200 mg KOH/g or greater, or as further examples, about 250 mg KOH/g or greater, or about 350 mg KOH/g or greater, or about 375 mg KOH/g or greater, or about 400 mg KOH/g or greater. The TBN being measured by the method of ASTM D2896.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased calcium phenate detergents have a total base number of at least about 150 mg KOH/g, at least about 225 mg KOH/g, at least about 225 mg KOH/g to about 400 mg KOH/g, at least about 225 mg KOH/g to about 350 mg KOH/g or about 230 mg KOH/g to about 350 mg KOH/g, all as measured by the method of ASTM D2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

The overbased detergent may have a metal to substrate ratio of from 1.1:1, or from 2:1, or from 4:1, or from 5:1, or from 7:1, or from 10:1. In some embodiments, a detergent is effective at reducing or preventing rust in an engine or other automotive part such as a transmission or gear. The detergent may be present in a lubricating composition at about 0 wt % to about 10 wt %, or about 0.1 wt % to about 8 wt %, or about 1 wt % to about 4 wt %, or greater than about 4 wt % to about 8 wt %.

Extreme Pressure Agents: The lubricating oil compositions herein also may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; organic sulfides and polysulfides such as dibenzyldisulfide, bis(chlorobenzyl) disulfide, dibutyl tetrasulfide, sulfurized methyl ester of oleic acid, sulfurized alkyl phenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers: The lubricating oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0 wt % to about 10 wt %, or about 0.01 wt % to about 8 wt %, or about 0.1 wt % to about 4 wt %.

Molybdenum-containing component: The lubricating oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan® 822, Molyvan® A, Molyvan® 2000 and Molyvan® 855 from R. T. Vanderbilt Co., Ltd., and Adeka Sakura-Lube® S-165, S-200, S-300, S-310G, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference in its entirety.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Transition Metal-containing compounds: In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl-(or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl-(or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150 °C for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150 °C for 1.5 hours, to produce a titanium-modified succinimide dispersant.

Another titanium containing compound may be a reaction product of titanium alkoxide and $C_6$ to $C_{25}$ carboxylic acid. The reaction product may be represented by the following formula:

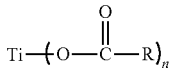

wherein n is an integer selected from 2, 3 and 4, and R is a hydrocarbyl group containing from about 5 to about 24 carbon atoms, or by the formula:

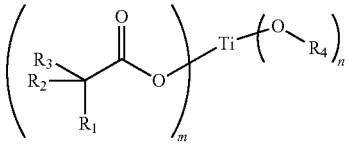

wherein m+n=4 and n ranges from 1 to 3, $R_4$ is an alkyl moiety with carbon atoms ranging from 1-8, $R_1$ is selected from a hydrocarbyl group containing from about 6 to 25 carbon atoms, and $R_2$ and $R_3$ are the same or different and are selected from a hydrocarbyl group containing from about 1 to 6 carbon atoms, or the titanium compound may be represented by the formula:

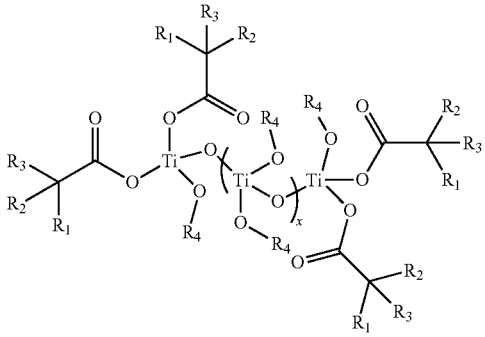

wherein x ranges from 0 to 3, $R_1$ is selected from a hydrocarbyl group containing from about 6 to 25 carbon atoms, $R_2$, and $R_3$ are the same or different and are selected from a hydrocarbyl group containing from about 1 to 6 carbon atoms, and $R_4$ is selected from a group consisting of either H, or C6 to C25 carboxylic acid moiety.

Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the lubricating oil composition in an amount to provide from 0 to 3000 ppm titanium by weight or 25 to about 1500 ppm titanium by weight or about 35 ppm to 500 ppm titanium by weight or about 50 ppm to about 300 ppm.

Viscosity Index Improvers: The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, of the lubricating oil composition.

Other Optional Additives: Other additives may be selected to perform one or more functions required of a lubricating fluid. Further, one or more of the mentioned additives may be multi-functional and provide functions in addition to or other than the function prescribed herein.

A lubricating oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid.

The rust inhibitor, if present, can be used in an amount sufficient to provide about 0 wt % to about 5 wt %, about 0.01 wt % to about 3 wt %, about 0.1 wt % to about 2 wt %, based upon the final weight of the lubricating oil composition.

In general terms, a suitable lubricant including the detergent metals herein may include additive components in the ranges listed in the following table.

TABLE 2

Suitable Lubricating Compositions

| Component | Wt. % (Suitable Embodiments) | Wt. % (Suitable Embodiments) |
|---|---|---|
| Detergent Systems | 0.02-5.0 | 0.2-2.0 |
| Dispersant(s) | 0-8.0 | 1-6.0 |
| Antioxidant(s) | 0.1-<2.0 | 0.01-1.5 |
| Other Detergent(s) | 0.0-15.0 | 0.2-8.0 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0.0-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) | 0.0-25.0 | 0.1-15.0 |
| Dispersant viscosity index improver(s) | 0.0-10.0 | 0.0-5.0 |
| Friction modifier(s) | 0.00-5.0 | 0.01-2.0 |
| Base oil (limited GIV as noted above) | Balance | Balance |
| Total | 100 | 100 |

The percentages of each component above represent the weight percent of each component, based upon the weight of the final lubricating oil composition. The remainder of the lubricating oil composition consists of one or more base oils. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). Fully formulated lubricants conventionally contain an additive package, referred to herein as a dispersant/inhibitor package or DI package, that will supply the characteristics that are required in the formulation.

DEFINITIONS

For purposes of this disclosure, the chemical elements are identified in accordance with the Periodic Table of the Elements, CAS version, Handbook of Chemistry and Physics, 75th Ed. Additionally, general principles of organic chemistry are described in "Organic Chemistry", Thomas Sorrell, University Science Books, Sausolito: 1999, and "March's Advanced Organic Chemistry", 5th Ed., Ed.:

Smith, M. B. and March, J., John Wiley & Sons, New York: 2001, the entire contents of which are hereby incorporated by reference.

As described herein, compounds may optionally be substituted with one or more substituents, such as are illustrated generally above, or as exemplified by particular classes, subclasses, and species of the disclosure.

Unless otherwise apparent from the context, the term "major amount" is understood to mean an amount greater than or equal to 50 weight percent, for example, from about 80 to about 98 weight percent relative to the total weight of the composition. Moreover, as used herein, the term "minor amount" is understood to mean an amount less than 50 weight percent relative to the total weight of the composition.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include: (1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); (2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); (3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein the term "aliphatic" encompasses the terms alkyl, alkenyl, alkynyl, each of which being optionally substituted as set forth below.

As used herein, an "alkyl" group refers to a saturated aliphatic hydrocarbon group containing 1-12 (e.g., 1-8, 1-6, or 1-4) carbon atoms. An alkyl group can be straight or branched. Examples of alkyl groups include, but are not limited to, methyl, ethyl, propyl, isopropyl, butyl, isobutyl, sec-butyl, tert-butyl, n-pentyl, n-heptyl, or 2-ethylhexyl. An alkyl group can be substituted (i.e., optionally substituted) with one or more substituents such as halo, phospho, cycloaliphatic [e.g., cycloalkyl or cycloalkenyl], heterocycloaliphatic [e.g., heterocycloalkyl or heterocycloalkenyl], aryl, heteroaryl, alkoxy, aroyl, heteroaroyl, acyl [e.g., (aliphatic) carbonyl, (cycloaliphatic)carbonyl, or (heterocycloaliphatic) carbonyl], nitro, cyano, amido [e.g., (cycloalkylalkyl) carbonylamino, arylcarbonylamino, aralkylcarbonylamino, (heterocycloalkyl) carbonylamino, (heterocycloalkylalkyl) carbonylamino, heteroarylcarbonylamino, heteroaralkyl carbonylamino alkylaminocarbonyl, cycloalkylaminocarbonyl, heterocycloalkylaminocarbonyl, arylaminocarbonyl, or heteroarylaminocarbonyl], amino [e.g., aliphaticamino, cycloaliphatic amino, or heterocycloaliphaticamino], sulfonyl [e.g., aliphatic-$SO_2$—], sulfinyl, sulfanyl, sulfoxy, urea, thiourea, sulfamoyl, sulfamide, oxo, carboxy, carbamoyl, cycloaliphaticoxy, heterocyclo aliphaticoxy, aryloxy, heteroaryloxy, aralkyloxy, heteroarylalkoxy, alkoxycarbonyl, alkyl carbonyloxy, or hydroxy. Without limitation, some examples of substituted alkyls include carboxyalkyl (such as HOOC-alkyl, alkoxycarbonylalkyl, and alkylcarbonyloxyalkyl), cyanoalkyl, hydroxyalkyl, alkoxyalkyl, acylalkyl, aralkyl, (alkoxyaryl)alkyl, (sulfonylamino) alkyl (such as (alkyl-$SO_2$-amino)alkyl), aminoalkyl, amidoalkyl, (cycloaliphatic)alkyl, or haloalkyl.

As used herein, an "alkenyl" group refers to an aliphatic carbon group that contains 2-8 (e.g., 2-12, 2-6, or 2-4) carbon atoms and at least one double bond. Like an alkyl group, an alkenyl group can be straight or branched. Examples of an alkenyl group include, but are not limited to allyl, isoprenyl, 2-butenyl, and 2-hexenyl. An alkenyl group can be optionally substituted with one or more substituents such as halo, phospho, cycloaliphatic [e.g., cycloalkyl or cycloalkenyl], heterocycloaliphatic [e.g., heterocycloalkyl or hetero cycloalkenyl], aryl, heteroaryl, alkoxy, aroyl, heteroaroyl, acyl [e.g., (aliphatic)carbonyl, (cycloaliphatic)carbonyl, or (heterocycloaliphatic)carbonyl], nitro, cyano, amido [e.g., (cycloalkylalkyl)carbonylamino, arylcarbonylamino, aralkylcarbonylamino, (hetero cycloalkyl) carbonylamino, (heterocyclo alkylalkyl) carbonylamino, heteroarylcarbonylamino, heteroaralkylcarbonylamino alkylamino carbonyl, cycloalkylaminocarbonyl, hetero cyclo alkylaminocarbonyl, arylaminocarbonyl, or heteroarylaminocarbonyl], amino [e.g., aliphaticamino, cycloaliphaticamino, heterocyclo aliphaticamino, or aliphaticsulfonylamino], sulfonyl [e.g., alkyl-$SO_2$—, cycloaliphatic-$SO_2$—, or aryl-$SO_2$—], sulfinyl, sulfanyl, sulfoxy, urea, thiourea, sulfamoyl, sulfamide, oxo, carboxy, carbamoyl, cycloaliphaticoxy, heterocycloaliphaticoxy, aryloxy, heteroaryloxy, aralkyloxy, heteroaralkoxy, alkoxycarbonyl, alkylcarbonyloxy, or hydroxy. Without limitation, some examples of substituted alkenyls include cyanoalkenyl, alkoxyalkenyl, acylalkenyl, hydroxyl alkenyl, aralkenyl, (alkoxyaryl) alkenyl, (sulfonylamino)alkenyl (such as (alkyl-$SO_2$-amino) alkenyl), aminoalkenyl, amidoalkenyl, (cycloaliphatic)alkenyl, or haloalkenyl.

As used herein, an "alkynyl" group refers to an aliphatic carbon group that contains 2-8 (e.g., 2-12, 2-6, or 2-4) carbon atoms and has at least one triple bond. An alkynyl group can be straight or branched. Examples of an alkynyl group include, but are not limited to, propargyl and butynyl. An alkynyl group can be optionally substituted with one or more substituents such as aroyl, heteroaroyl, alkoxy, cycloalkyloxy, heterocycloalkyloxy, aryloxy, heteroaryloxy, aralkyl oxy, nitro, carboxy, cyano, halo, hydroxy, sulfo, mercapto, sulfanyl [e.g., aliphaticsulfanyl or cycloaliphaticsulfanyl], sulfinyl [e.g., aliphaticsulfinyl or cycloaliphaticsulfinyl], sulfonyl [e.g., aliphatic-$SO_2$—, aliphaticamino-$SO_2$—, or cycloaliphatic-$SO_2$—], amido [e.g., aminocarbonyl, alkylaminocarbonyl, alkylcarbonylamino, cyclo alkylaminocarbonyl, heterocycloalkylaminocarbonyl, cycloalkylcarbonylamino, arylamino carbonyl, arylcarbonylamino, aralkylcarbonylamino, (heterocycloalkyl) carbonylamino, (cycloalkylalkyl) carbonylamino, heteroaralkylcarbonylamino, heteroaryl carbonylamino or heteroaryl amino carbonyl], urea, thiourea, sulfamoyl, sulfamide, alkoxycarbonyl, alkyl carbonyloxy, cyclo aliphatic, heterocycloaliphatic, aryl, heteroaryl, acyl [e.g., (cycloaliphatic) carbonyl or (hetero cyclo aliphatic)carbonyl], amino [e.g., aliphaticamino], sulfoxy, oxo, carboxy, carbamoyl, (cycloaliphatic)oxy, (heterocyclo aliphatic)oxy, or (heteroaryl)alkoxy.

As used herein, an "amino" group refers to —$NR^XR^Y$ wherein each of $R^X$ and $R^Y$ is independently hydrogen, alkyl, cycloakyl, (cycloalkyl)alkyl, aryl, aralkyl, heterocycloalkyl, (heterocycloalkyl)alkyl, heteroaryl, carboxy, sulfanyl, sulfinyl, sulfonyl, (alkyl)carbonyl, (cycloalkyl)carbonyl, ((cycloalkyl)alkyl)carbonyl, arylcarbonyl, (aralkyl)carbonyl, (heterocyclo alkyl)carbonyl, ((heterocycloalkyl)alkyl)carbonyl, (heteroaryl)carbonyl, or (heteroaralkyl)carbonyl, each of which being defined herein and being optionally substituted. Examples of amino groups include alkylamino, dialkylamino, or arylamino. When the term "amino" is not the terminal group (e.g., alkylcarbonylamino), it is represented by —$NR^X$—. $R^X$ has the same meaning as defined above.

As used herein, a "cycloalkyl" group refers to a saturated carbocyclic mono- or bicyclic (fused or bridged) ring of 3-10 (e.g., 5-10) carbon atoms. Examples of cycloalkyl groups include cyclopropyl, cyclobutyl, cyclopentyl, cyclohexyl, cycloheptyl, adamantyl, norbornyl, cubyl, octahydroindenyl, decahydro-naphthyl, bicyclo[3.2.1]octyl, bicyclo[2.2.2]octyl, bicyclo[3.3.1]nonyl, bicyclo[3.3.2]decyl, bicyclo[2.2.2]octyl, adamantyl, or ((aminocarbonyl)cycloalkyl)cycloalkyl.

As used herein, a "heterocycloalkyl" group refers to a 3-10 membered mono- or bicylic (fused or bridged) (e.g., 5- to 10-membered mono- or bicyclic) saturated ring structure, in which one or more of the ring atoms is a heteroatom (e.g., N, O, S, or combinations thereof). Examples of a heterocycloalkyl group include piperidyl, piperazyl, tetrahydropyranyl, tetrahydrofuryl, 1,4-dioxolanyl, 1,4-dithianyl, 1,3-dioxolanyl, oxazolidyl, isoxazolidyl, morpholinyl, thiomorpholyl, octahydrobenzofuryl, octahydrochromenyl, octahydrothio chromenyl, octahydroindolyl, octahydropyrindinyl, decahydroquinolinyl, octahydrobenzo[b] thiopheneyl, 2-oxa-bicyclo[2.2.2]octyl, 1-aza-bicyclo[2.2.2]octyl, 3-aza-bicyclo[3.2.1]octyl, and 2,6-dioxa-tricyclo[3.3.1.0]nonyl. A monocyclic heterocycloalkyl group can be fused with a phenyl moiety to form structures, such as tetrahydroisoquinoline, which would be categorized as heteroaryls.

A "heteroaryl" group, as used herein, refers to a monocyclic, bicyclic, or tricyclic ring system having 4 to 15 ring atoms wherein one or more of the ring atoms is a heteroatom (e.g., N, O, S, or combinations thereof) and in which the monocyclic ring system is aromatic or at least one of the rings in the bicyclic or tricyclic ring systems is aromatic. A heteroaryl group includes a benzofused ring system having 2 to 3 rings. For example, a benzofused group includes benzo fused with one or two 4 to 8 membered heterocycloaliphatic moieties (e.g., indolizyl, indolyl, isoindolyl, 3H-indolyl, indolinyl, benzo[b]furyl, benzo[b]thiophenyl, quinolinyl, or isoquinolinyl). Some examples of heteroaryl are pyridyl, 1H-indazolyl, furyl, pyrrolyl, thienyl, thiazolyl, oxazolyl, imidazolyl, tetrazolyl, benzofuryl, isoquinolinyl, benzthiazolyl, xanthene, thioxanthene, phenothiazine, dihydroindole, benzo[1,3]dioxole, benzo[b]furyl, benzo[b]thiophenyl, indazolyl, benzimidazolyl, benzthiazolyl, puryl, cinnolyl, quinolyl, quinazolyl, cinnolyl, phthalazyl, quinazolyl, quinoxalyl, isoquinolyl, 4H-quinolizyl, benzo-1,2,5-thiadiazolyl, or 1,8-naphthyridyl.

Without limitation, monocyclic heteroaryls include furyl, thiophenyl, 2H-pyrrolyl, pyrrolyl, oxazolyl, thazolyl, imidazolyl, pyrazolyl, isoxazolyl, isothiazolyl, 1,3,4-thiadiazolyl, 2H-pyranyl, 4-H-pranyl, pyridyl, pyridazyl, pyrimidyl, pyrazolyl, pyrazyl, or 1,3,5-triazyl. Monocyclic heteroaryls are numbered according to standard chemical nomenclature.

Without limitation, bicyclic heteroaryls include indolizyl, indolyl, isoindolyl, 3H-indolyl, indolinyl, benzo[b]furyl, benzo[b]thiophenyl, quinolinyl, isoquinolinyl, indolizinyl, isoindolyl, indolyl, benzo[b]furyl, bexo[b]thiophenyl, indazolyl, benzimidazyl, benzthiazolyl, purinyl, 4H-quinolizyl, quinolyl, isoquinolyl, cinnolyl, phthalazyl, quinazolyl, quinoxalyl, 1,8-naphthyridyl, or pteridyl. Bicyclic heteroaryls are numbered according to standard chemical nomenclature.

As used herein, the term "treat rate" refers to the weight percent of a component in the lubricating and cooling fluids.

The weight average molecular weight (Mw) and the number average molecular weight (Mn) may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40 °C. Un-stabilized HPLC grade tetrahydrofuran (THF) may be used as solvent, at a flow rate of 1.0 mL/min. The GPC instrument may be calibrated with commercially available poly(methyl methacrylate) (PMMA) standards having a narrow molecular weight distribution ranging from 960-1,568,000 g/mol. The calibration curve can be extrapolated for samples having a mass less than 500 g/mol. Samples and PMMA standards can be in dissolved in THF and prepared at concentration of 0.1 to 0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

EXAMPLES

A better understanding of the present disclosure and its many advantages may be clarified with the following examples. The following examples are illustrative and not limiting thereof in either scope or spirit. Those skilled in the art will readily understand that variations of the components, methods, steps, and devices described in these examples can be used. Unless noted otherwise or apparent from the context of discussion in the Examples below and throughout this disclosure, all percentages, ratios, and parts noted in this disclosure are by weight. Any standardized test method noted in the Examples, disclosure, or claims, unless apparent from the context of its use, refers to the version of the test method publically available at the time of the filing of the present disclosure.

Example 1

Lubricating compositions were evaluated for piston cleanliness pursuant to CEC L-117-20 (TDi3). The lubricating compositions evaluated for this Example included sulfonate and/or phenate detergents to provide the fluid relationships of Table 3 below as well as a similar additive package including dispersants, antiwear additives, aminic antioxidants, phenolic antioxidants, molybdenum antioxidants, friction modifiers, antifoam agents, pour point depressants, viscosity modifiers, and the balance base oil to achieve a KV100 of about 4.0 to about 26.1 cSt. (KV100 was measured pursuant to ASTM D445.) Table 4 provides the VW TDi3 piston cleanliness results.

TABLE 3

| Fluid Relationships | | | | | | | |
|---|---|---|---|---|---|---|---|
| | Baseline | Compare 1 | Compare 2 | Inventive 1 | Inventive 2 | Compare 3 | Inventive 3 |
| Sulfonate soap, %* | 0.23 | 0.50 | 0.25 | 0.75 | 0.4 | 0.34 | 0.62 |
| Phenate soap, %* | 0.25 | 0.25 | 0.50 | 0.0 | 0.0 | 0.39 | 0.0 |
| Total soap, %* | 0.48 | 0.75 | 0.75 | 0.75 | 0.4 | 0.72 | 0.62 |
| Phenate-to-Sulfonate | 1.1:1 | 0.5:1 | 2.0:1 | 0:1 | 0:1 | 1.1:1 | 0:1 |
| Sulfonate-to-Phenate | 0.92:1 | 2:1 | 0.5:1 | — | — | 0.9:1 | — |
| Calcium, ppm | 1379 | 2073 | 1992 | 2155 | 0 | 1230 | 1351 |
| Magnesium, ppm | 382 | 0 | 0 | 5 | 1325 | 1248 | 1248 |
| Boron, ppm | 61 | 61 | 61 | 61 | 0 | 0 | 0 |
| Detergent system TBN (ASTM D2896) | 5.4 | 5.1 | 5.1 | 5.1 | 5.7 | 8.7 | 8.8 |
| API Group III, wt % | 82.6 | 81.9 | 81.9 | 81.9 | 85.4 | 76.6 | 76.8 |
| API Group IV, wt % | 0 | 0 | 0 | 0 | 0 | 0 | 0 |
| Total Antioxidant, wt % | 1.7 | 1.7 | 1.7 | 1.7 | 1.2 | 1.2 | 1.2 |
| Ratio TBN (D2896) to Sulfonate Soap (%)** | 23.5 | 10.2 | 20.4 | 6.8 | 14.3 | 25.6 | 14.2 |

*wt % soap in final formulation

**Ratio is detergent TBN (D2896) divided by weight percent of sulfonate soap in the final formulation. Thus, Compare 1 has a ratio of 5.1/0.5 or 10.5 and reflects the balancing of detergent TBN contribution to the sulfonate soap contribution. Preferred lubricants have a ratio of 13-18 or 14-16.

TABLE 4

| CEC L-117-20 (VW TDi3) Piston Cleanliness | | | | | | | |
|---|---|---|---|---|---|---|---|
| | Baseline | Compare 1 | Compare 2 | Inventive 1 | Inventive 2 | Compare 3 | Inventive 3 |
| Piston Cleanliness | 49 | 52 | 49 | 51 | 54 | 53 | 53 |
| RL 276-5, merit | 53 | 53 | 53 | 53 | 53 | 54 | 53 |
| Pass/Fail | FAIL | FAIL | FAIL | FAIL | PASS | FAIL | PASS |

Piston cleanliness is measured to RL276-5, where passing piston cleanliness is equivalent to or better than the RL 276-5 reference fluid merits. Comparative 1 and 2 having a blend of sulfonate and phenate soaps failed to achieve passing piston cleanliness under the TDi3 performance criteria. Comparative 3 having only sulfonate soap still failed TDi3 performance because the lubricant did not balance the detergent TBN (ASTM D2896) contribution to the sulfonate soap levels. It was unexpected that Inventive lubricant 1 passed TDi3 piston cleanliness with only sulfonate soap when having a limited amount of boron and a lower total antioxidant content but such lubricant achieved passing TDi3 performance when selecting sulfonate only detergents together with the select detergent TBN contribution (ASTM D2896).

Comparative lubricant 4 with a blend of sulfonate and phenate soaps, even with a higher detergent TBN contribution (ASTM D2896), surprisingly failed TDi3 performance because it did not balance TBN to sulfonate soap contributions. Inventive 2 shows that switching the lubricant from a mixed phenate and sulfonate formulation achieved passing TDi3 performance when the detergent TBN also was matched with the sulfonate soap contents, antioxidant contents, and less than about 20 weight percent Group IV base oils. Inventive lubricants herein also included lower levels of total antioxidants (e.g., less than about 2 weight percent of amine antioxidants, phenolic antioxidants, and molybdenum antioxidants), lower amounts of boron content (e.g., about 100 ppm or less), and little to no API Group IV base oils (e.g., about 20 weight percent or less).

Example 2

Further lubricating compositions including the detergent additives of Example 1 were evaluated for piston cleanliness using the older CEC L-078-99 or VW TDi2 test. The lubricants of this Example included the fluid relationships of Table 5 below in addition to the same additive package of antioxidants, antiwear additives, phenolic antioxidants, molybdenum antioxidants, friction modifiers, antifoam additives, pour point depressants, viscosity modifiers, and balance of base oil to achieve a KV100 of about 4 to about 26.1 cSt. (KV100 measured pursuant to ASTM D445.) Table 6 provides the VW TDi2 piston cleanliness.

TABLE 5

| Fluid Relationships | | | | |
|---|---|---|---|---|
| | Compare 5 | Compare 6 | Compare 7 | Compare 8 |
| Sulfonate soap, % | 0.48 | 0.34 | 0.88 | 0.92 |
| Phenate soap, % | 0.0 | 0.40 | 0.0 | 0.0 |
| Total soap, % | 0.48 | 0.74 | 0.88 | 0.92 |
| Phenate-to-Sulfonate | 0 | 1.2 | 0 | 0 |

TABLE 5-continued

| Fluid Relationships | | | | |
|---|---|---|---|---|
| | Compare 5 | Compare 6 | Compare 7 | Compare 8 |
| Detergent system TBN (ASTM D2896) | 7.8 | 7.3 | 6.5 | 4.5 |
| Calcium, ppm | 2261 | 2074 | 1958 | 1267 |
| Magnesium, ppm | 0 | 0 | 0 | 0 |
| Boron, ppm | 261 | 261 | 261 | 261 |
| API, Group III, wt % | 80.6 | 80.3 | 79.8 | 80.0 |
| Total Antioxidant, wt % | 0.8 | 0.8 | 0.8 | 0.8 |

TABLE 6

| CEC L-078-99 (VW TDi2) Piston Cleanliness | | | | |
|---|---|---|---|---|
| | Compare 5 | Compare 6 | Compare 7 | Compare 8 |
| Piston Cleanliness | 63 | 66 | 64 | 62 |

Passing piston cleanliness of TDi2 was a piston cleanliness equivalent to or better than a reference fluid, which was generally a piston cleanliness rating of greater than about 65. The data of Table 6 shows that detergent systems having a majority of sulfonate soap (e.g., Comparative 5, 7, and 8) failed to give adequate piston cleanliness when evaluated using the older VW TDi2 performance criteria. However, the data of Table 4 from Example 1 shows that when high enough TBN levels are balanced in a lubricant having a majority sulfonate (and preferably sulfonate only) detergent system, the lubricants can surprisingly achieve desired piston cleanliness pursuant to the more severe and new VW TDi3 performance criteria even when the lubricants have lower levels of total antioxidants (e.g., less than 2.0 weight percent), lower levels of boron (e.g., less than about 100 ppm), and/or lower levels of API Group IV base oils (e.g., less than about 20 weight percent).

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A lubricating composition comprising:

one or more base oils of lubricating viscosity;

about 0.5 to about 1.3 weight percent of total antioxidant compounds selected from aminic antioxidant compounds, phenolic antioxidant compounds, molybdenum antioxidant compounds, or combinations thereof;

free of boron;

a detergent system providing about 0.3 to about 0.7 weight percent of sulfonate soap to the lubricating composition and having a total base number (TBN) of 5.5 to 8.8 mg KOH/g as measured by ASTM D2896, wherein the detergent system consists essentially of one or more of magnesium sulfonate, sodium sulfonate, or calcium sulfonate in amounts to provide the detergent system TBN and providing about 1000 to about 3000 ppm of metal, wherein the lubricating composition has a ratio of the detergent system TBN (ASTM D2896) relative to the sulfonate soap content of 13 to 16, wherein the detergent system is a blend of neutral sulfonate detergents and overbased sulfonate detergents in amounts to provide the detergent system TBN, and wherein the neutral sulfonate detergents have a TBN of less than 200 mg KOH/gram and the overbased sulfonate detergents have a TBN of 200 mg KOH/gram or higher;

wherein the lubricating composition includes less than 20 weight percent of API Group IV base oils;

wherein the lubricating composition further includes a dispersant, an antiwear additive, a friction modifier, an antifoam agent, a pour point depressant, and a viscosity modifier; and wherein the lubricating composition exhibits an average piston cleanliness of 53 merits or higher in the CEC L-117-20 (VW TDi3) piston cleanliness test of RL276-5.

2. The lubricating composition of claim 1, wherein the detergent system includes only magnesium sulfonate, sodium sulfonate, calcium sulfonate, or combinations thereof in amounts to provide the detergent system TBN.

3. The lubricating composition of claim 1, wherein the detergent system has about 1 weight percent or less of phenate soap, salicylate soap, calixarate soap, or combinations thereof.

4. The lubricating composition of claim 1, wherein the detergent system provides at least one of calcium, magnesium, sodium, or combination thereof in amounts, individually or in combination, of 1300 to 2600 ppm.

5. The lubricating composition of claim 1, wherein the lubricating composition has less than about 5 weight percent of API Group IV base oils.

6. The lubricating composition of claim 1, wherein the detergent system includes up to about 7 weight percent of sulfonate detergents from the neutral sulfonate detergents and about 0.1 to about 3.0 weight percent of sulfonate detergents from the overbased sulfonate detergents.

7. A method of passing the CEC L-117-20 piston cleanliness test, the method comprising:

providing a lubricating composition including one or more base oils of lubricating viscosity; about 0.5 to 1.3 weight percent of total antioxidant compounds selected from aminic antioxidant compounds, phenolic antioxidant compounds, molybdenum antioxidant compounds, or combinations thereof; free of boron; a detergent system providing about 0.3 to about 0.7 weight percent of sulfonate soap and having a total base number (TBN) of 5.5 to 8.8 mg KOH/g as measured by ASTM D2896, wherein the detergent system consists essentially of one or more of magnesium sulfonate, sodium sulfonate, or calcium sulfonate in amounts to provide the detergent system TBN and providing about 1000 to about 3000 ppm of metal, wherein the lubricating composition has a ratio of the detergent system TBN (ASTM D2896) relative to the sulfonate soap content of 13 to 16, wherein the detergent system is a blend of neutral sulfonate detergents and overbased sulfonate detergents in amounts to provide the detergent system TBN, and wherein the neutral sulfonate detergents have a TBN of less than 200 mg KOH/gram and the overbased sulfonate detergents have a TBN of 200 mg KOH/gram or higher; and less than 20 weight percent of API Group IV base oils;

wherein the lubricating composition further includes a dispersant, an antiwear additive, a friction modifier, an antifoam agent, a pour point depressant, and a viscosity modifier; and measuring piston cleanliness pursuant to CEC L-117-20 (VW TDi3) and wherein the lubricating composition has an average piston cleanliness of 53 merits or higher in the CEC L-117-20 test of RL276-5.

8. The method of claim 7, wherein the detergent system includes only magnesium sulfonate, sodium sulfonate, calcium sulfonate, or combinations thereof in amounts to provide the detergent system TBN.

9. The method of claim 7, wherein the detergent system is substantially free of detergents providing phenate soap, salicylate soap, calixarate soap, or combinations thereof.

10. The method of claim 7, wherein the detergent system has about 1 weight percent or less of phenate soap, salicylate soap, calixarate soap, or combinations thereof.

11. The method of claim 7, wherein the detergent system provides at least one of calcium, magnesium, sodium, or combination thereof in amounts, individually or in combination, of 1300 to 2600 ppm.

12. The method of claim 7, wherein the detergent system includes up to about 7 weight percent of sulfonate detergent from the neutral sulfonate detergents and about 0.1 to about 3 weight percent of sulfonate detergent from the overbased sulfonate detergents.

13. The method of claim 7, wherein the lubricating composition has less than about 5 weight percent of API Group IV base oils.

* * * * *